US006821219B2

(12) United States Patent
Thurber

(10) Patent No.: US 6,821,219 B2
(45) **Date of Patent: *Nov. 23, 2004**

(54) GRAPHITE ARROW AND METHOD OF MANUFACTURE

(76) Inventor: Glen E. Thurber, 3530 SE. 21st St., Topeka, KS (US) 66607

( * ) Notice: Subject to any disclaimer, the term of this patent is extended or adjusted under 35 U.S.C. 154(b) by 0 days.

This patent is subject to a terminal disclaimer.

(21) Appl. No.: 09/886,513

(22) Filed: Jun. 21, 2001

(65) Prior Publication Data

US 2002/0006839 A1 Jan. 17, 2002

Related U.S. Application Data

(63) Continuation-in-part of application No. 09/771,822, filed on Jan. 29, 2001, now Pat. No. 6,554,726, which is a continuation-in-part of application No. 09/227,139, filed on Jan. 7, 1999, now Pat. No. 6,179,736.

(51) Int. Cl.[7] ..... F42B 6/04
(52) U.S. Cl. ..... 473/578
(58) Field of Search ..... 473/578, FOR 216

(56) References Cited

U.S. PATENT DOCUMENTS 4,050,696 A 9/1977 Troncoso, Jr.
6,017,284 A 1/2000 Giles
6,251,036 B1 * 6/2001 Wu et al. ..... 473/578

FOREIGN PATENT DOCUMENTS

| | | |
|---|---|---|
| FR | 2689228 | 10/1993 |
| GB | 1590954 | 6/1981 |
| SU | 1675649 | 9/1991 |

OTHER PUBLICATIONS

ArrowTrade magazine, Jan., 1998, advertisement for Carbon Tech, Inc., p. 32.

ArrowTrade magazine, May, 1997, advertisement for Gold Tip.

Arrow Dynamics brochure, "Looks Like a Dart, Shoots Like a Dart Arrows", 2000–2001.

* cited by examiner

*Primary Examiner*—John A. Ricci

(57) ABSTRACT

A graphite archery arrow having an elongate shaft, a fletching portion at the end of the shaft, and a tip portion at the opposite end of the shaft, the shaft consisting of a number of graphite fibers longitudinally oriented along the shaft; a number of graphite fibers biased to the longitudinally oriented graphite fibers; and a binder holding together the longitudinally oriented graphite fibers and the biased graphite fibers. The arrow may also have a tapered portion and a parallel portion.

11 Claims, 7 Drawing Sheets

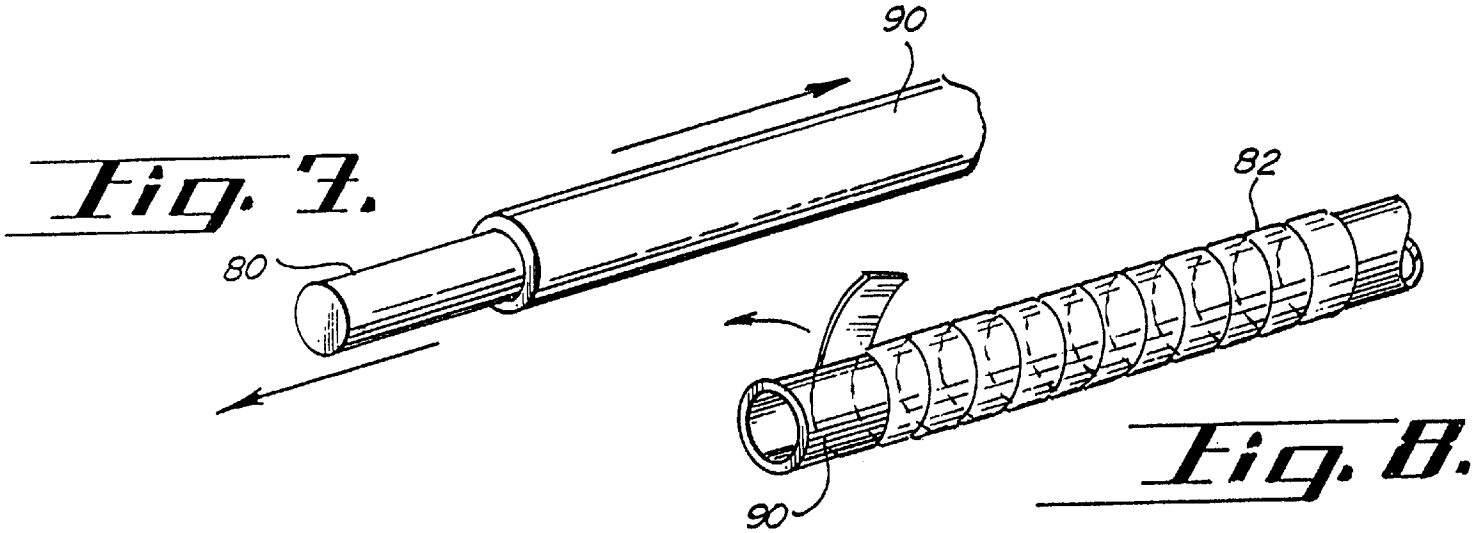
Fig. 8.
Fig. 7.
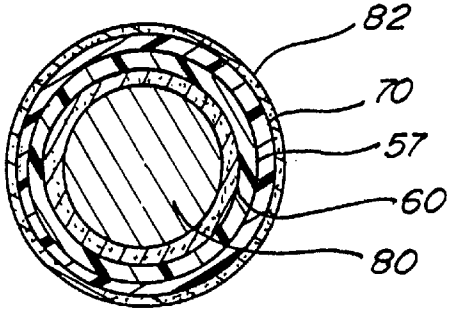
Fig. 6.

GRAPHITE ARROW AND METHOD OF MANUFACTURE

This application is a continuation-in-part of application Ser. No. 09/771,822, filed Jan. 29, 2001, now U.S. Pat. No. 6,544,726, which is a continuation-in-part of application Ser. No. 09/227,139, filed Jan. 7, 1999, now U.S. Pat. No. 6,179,736.

BACKGROUND OF THE INVENTION

The present invention relates to an archery arrow composed of graphite (carbon) with the carbon fibers running in two mutually, substantially perpendicular directions on the arrow shaft. In addition, the arrow shaft is partially tapered and partially non□tapered.

The earliest known archery arrows were made of wood, usually cedar. These arrows had a number of disadvantages. First, they warped when exposed to moisture. As a result of this warping they were not straight and therefore did not fly straight when released from the bow. In addition, they were quite fragile and broke when they hit a hard object. Furthermore, they did not have sufficient kinetic energy to penetrate targets such as large game animals.

The kinetic energy of an arrow in flight may be calculated according to the formula:

$$E = \frac{\text{weight} \times \text{velocity}^2}{450{,}240}$$

The disadvantages of wood arrows led to the development of aluminum tubular arrows. These arrows were about 25% lighter than cedar wood arrows and therefore flew faster (about 220 ft/sec), developing more kinetic energy because kinetic energy is related to the square of the velocity. They were also straighter than cedar arrows and did not have a tendency to warp. They were straight throughout the length of the shaft and did not taper.

However, aluminum arrows have a tendency to bend rather than break when they hit a hard object. It can be quite difficult to straighten the arrow after it has been bent.

More recently, carbon (graphite) arrows have been developed. Graphite arrows are constructed from carbon fibers that are pulled off a spool and through a die with eyelets, then through a smaller die and through a bath of polyvinyl or polyester resin and onto a mandrel for curing. After being placed on the mandrel, the carbon fibers and resin are heated to cure them. The cured product is then removed from the mandrel and cut to appropriate lengths for individual arrows. These arrows also generally had parallel walls (no taper).

These graphite arrows were lighter and tougher than aluminum, and do not bend when striking a hard object. The lighter weight lets them fly faster, developing higher kinetic energy.

These arrows also had a number of disadvantages. The production process left a mold release on the outside of the resin which was quite slippery. In order to fetch such arrows (put the vanes on), the arrows had to be sanded. Furthermore, it was quite difficult to tune these arrows for use with a fixed blade broadhead tip.

To address some of these problems, some manufacturers such as Taylor Falcon, Jonesboro, Ark. developed carbon arrows with a continuous taper throughout the length of the shaft. However, these arrows did not have commercial success because the sizings were wrong, the weights were inconsistent, and a dealer had to have many different diameter tools to mount tips to the shaft. That is, depending at the point along the taper where the material was cut to length, a different outside diameter of the shaft resulted and a different tool was needed to mount the tip. Furthermore, most of these arrows were constructed of unidirectional fibers, with the fibers running lengthwise along the shaft. There was thus no bracing across the shaft diameter, so that these arrows were relatively fragile In addition, these arrows tended to have a longer "paradox" or oscillation along the shaft which caused inaccuracy in flight and less penetration after hitting a game animal. Furthermore, they had a relatively limited "spine weight" range of stiffness, so that it was difficult to use them with heavier bow strengths (greater than 70 pounds). Crisscrossing or biasing of fibers has been tried.

There is a need for an improved graphite archery arrow that retains the advantages of tapered arrows while solving the problems of tapered arrows and correcting the problems with graphite arrows with no bias.

SUMMARY OF THE INVENTION

A graphite archery arrow having an elongate shaft, a fletching portion at one end of the shaft, and a tip portion at the opposite end of the shaft, the shaft consisting of a number of graphite fibers longitudinally oriented 4long the shaft; a number of graphite fibers biased to the longitudinally oriented graphite fibers; and a binder holding together the longitudinally oriented graphite fibers and the biased graphite fibers. The arrow may also have a tapered portion and a parallel portion. A method of manufacturing the graphite archery arrow is also claimed.

A principal object and advantage of the present invention is that the combination of longitudinally oriented graphite fibers and biased graphite fibers gives great strength to the arrow.

Another principal object and advantage of the present invention is that the arrow does not bend when it hits a hard object.

Another principal object and advantage of the present invention is that the arrow is lighter and weight and therefore flies faster, developing more kinetic energy.

Another object and advantage of the present invention is that there is no mold release on the outside of the arrow, so that extensive sanding is not required.

Another object and advantage of the present invention is that the arrow can be used with a fixed blade broadhead tip.

Another object and advantage of the present invention is that a parallel portion allows the arrow to be sized to almost any length and a tip attached with a single diameter tip adapter. The arrow can also be re-tipped easily if it shatters at some point along the parallel portion.

Another object and advantage of the present invention is that the increased strength allows the tip adapter to go inside the shaft so that it will not grab when removed from the target.

Another object and advantage of the present invention is that a tapered portion behind the parallel portion allows easier penetration into a game animal.

Another object and advantage of the present invention is that it has a shorter paradox than earlier arrows and thus has less oscillation along the shaft resulting in higher accuracy and flatter trajectory in flight. The arrow shoots farther with the same accuracy. This also allows better penetration when the arrow hits a game animal.

Another object and advantage of the present invention is that it has a greater spine weight range than earlier arrows.

Another object and advantage of the present invention is that it has a front of center about 10 to 15% closer to the tip, allowing better tuning for fixed blade broadhead tips.

Another object and advantage of the present invention is that the arrow is easier to tune than earlier arrows.

BRIEF DESCRIPTION OF THE DRAWINGS

FIG. 6 is a schematic of the layering of materials in certain steps of the method of manufacturing.

FIG. 7 is a perspective view of the finished product being pulled off a mandrel in the method of manufacturing.

FIG. 8 is a schematic showing removal of polypropylene tape from the finished product in the method of manufacturing.

DETAILED DESCRIPTION OF THE PREFERRED EMBODIMENT

Figure 1:
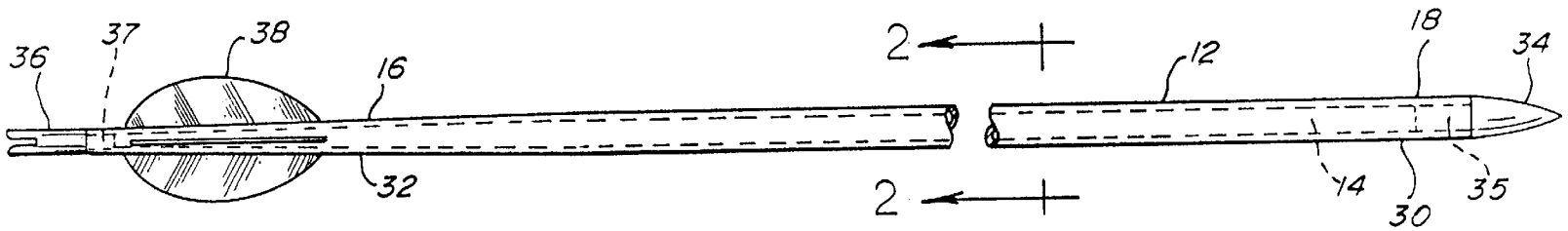
FIG. 1 is a right-side elevational view of the graphite archery arrow of the present invention with internal structure indicated by dashed lines.

The graphite archery arrow of the present invention is generally shown in the drawings as reference numeral 10.

The graphite archery arrow 10 has an elongate hollow shaft 12 with interior 14, a fletching portion 16 at one end of the shaft 12, and a tip portion 18 at the other end of the shaft 12.

Figure 2:
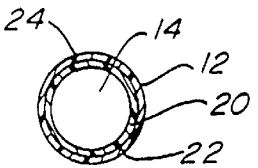
FIG. 2 is a cross-sectional view along the lines 2—2 of FIG. 1.

As can be seen best in FIG. 2, the shaft 12 comprises a plurality of graphite fibers 20 longitudinally oriented along the shaft 12; a plurality of graphite fibers 22 biased to the longitudinally oriented graphite fibers 20; and a binder 24 holding the longitudinally oriented graphite fibers 20 and biased graphite fibers 22 together.

In the preferred embodiment, the biased graphite fibers 22 are substantially normal (perpendicular) to the longitudinally oriented graphite fibers 20.

Most preferably, the longitudinally oriented graphite fibers 20 have a fiber area weight of about 120 g/m$^2$ and the biased graphite fibers 22 have a fiber area weight of about 70 g/m$^2$. A range of 80–125 g/m$^2$ is also suitable.

In the preferred embodiment, the binder 24 is a thermoplastic epoxy resin. However, other materials may be used which fill in the spaces between the longitudinally oriented graphite fibers 20 and the biased graphite fibers 22 and cure to form a hard, durable matrix material holding the fibers together.

To give additional strength to the arrow 10, there may be multiple layers of longitudinally oriented graphite fibers 20 and biased graphite fibers 22. Preferably, there are four layers of longitudinally oriented graphite fibers 20 and two layers of biased graphite fibers 22.

The Figures also show that the shaft 12 further comprises a parallel portion 30 of constant diameter and a tapered portion 32 of gradually narrowing diameter. Preferably, the parallel portion 30 is adjacent the tip portion 18 and the tapered portion 32 is adjacent the fletching portion 16. Most preferably, the parallel portion 30 is about 40% of the shaft 12 length and the tapered portion is about 60% of the shaft 12 length.

The shaft 12 may also further comprise a second parallel portion 39 adjacent the tapered portion 32, with the second parallel portion 39 forming the fletching portion 16. In this case, the parallel portion 35 is about 40% of the shaft length, the tapered portion 32 is about 50% of the shaft length, and the second parallel portion 39 is about 10% of the shaft length. Most preferably, the parallel portion is 39%, the tapered portion 53%, and the second parallel portion 8% of the shaft length.

The Figures also show a tip or pile 34 which may be attached to the tip portion 18 and a string nock 36 which may be attached adjacent the fletching portion 16 of the shaft 12. Vanes 38 are attached to the shaft 12 at the fletching portion 16.

Because of the unique construction of the shaft, the pile 34 may be attached to the shaft 12 by a pile adapter 35 which fits inside the shaft 12, so that the pile adapter 35 does not present an external surface to snag on the material of a target or game animal. Likewise, the nock 36 may be attached to the shaft 12 by a nock adapter 37 or by itself which fits inside the shaft 12.

In the event that the parallel portion 30 should break due to impact with a hard object, the tip 34 may be removed and remounted on the parallel portion 30 at a point closer to the fletching portion 16 using a single diameter tip adapter. Because the shaft is parallel near the tip portion, there is no need for various diameter-mounting tools as would be the case if the shaft 12 were tapered for its entire length.

Figure 3:
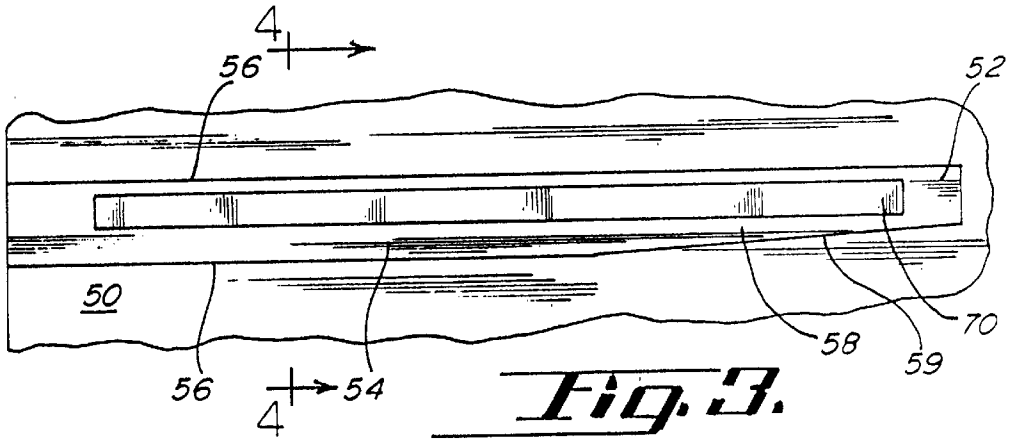
FIG. 3 is a schematic showing the materials used in a method of manufacturing the graphite arrow of the present invention.
Figure 4:
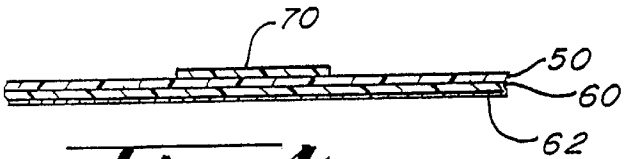
FIG. 4 is a schematic of the layering of materials in certain steps of the method of manufacturing.
Figure 9:
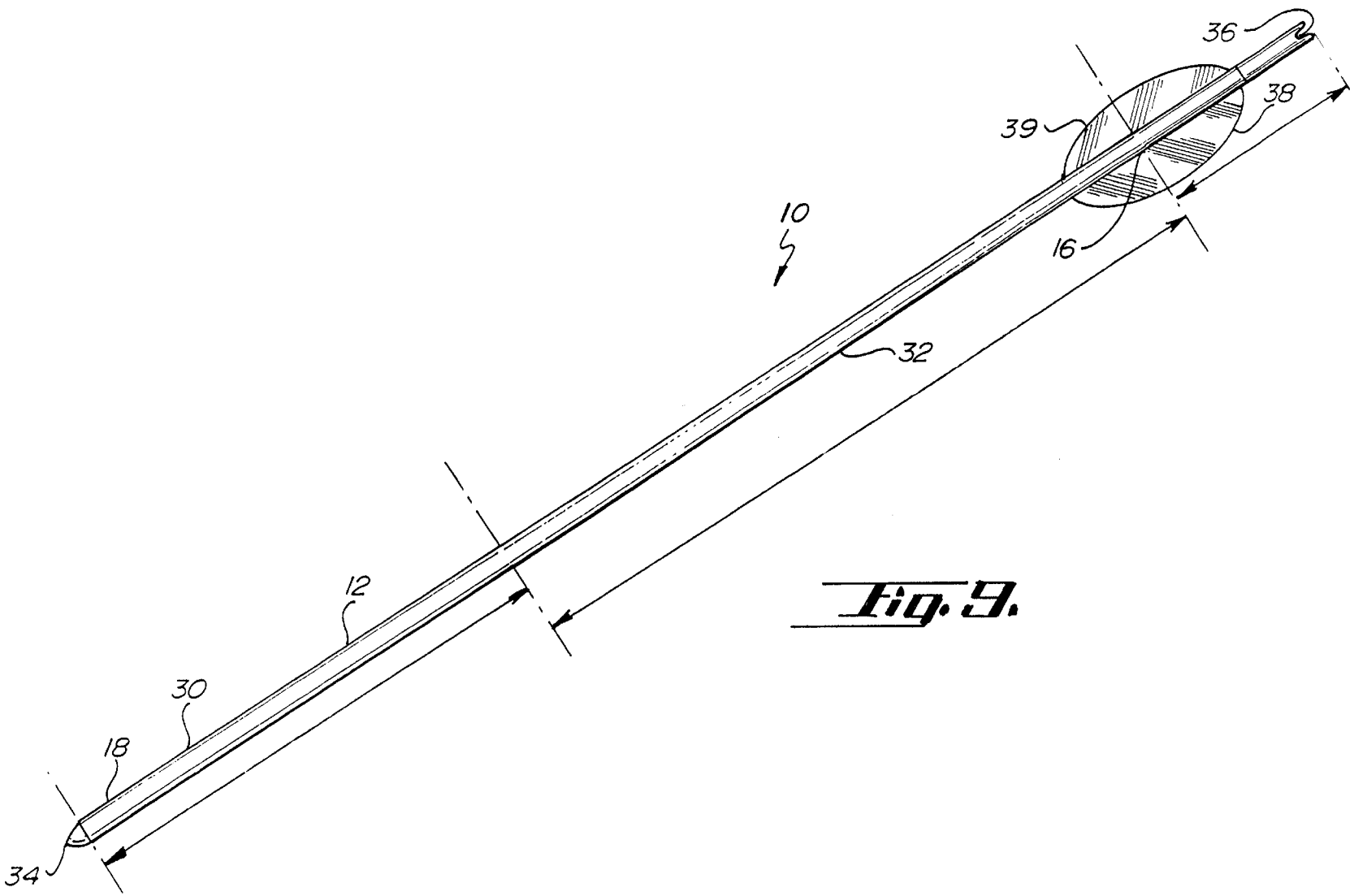
FIG. 9 is an elevational view of a second embodiment of the graphite archery arrow of the present invention.
Figure 10A:
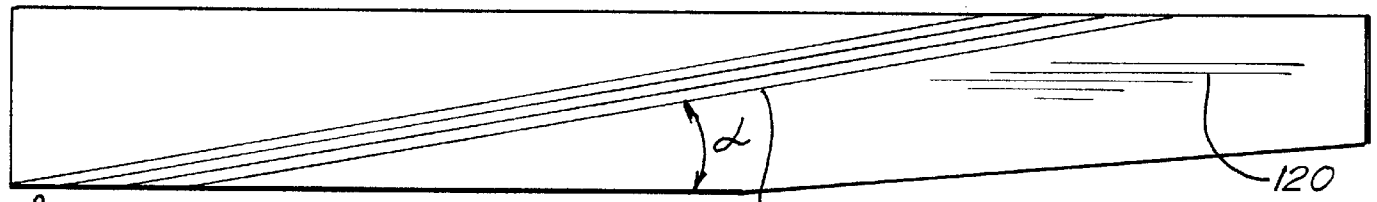
FIGS. 10*a*–10*i* are schematics of the layers of material used in constructing additional embodiments of the arrow of the present invention.
Figure 10B:
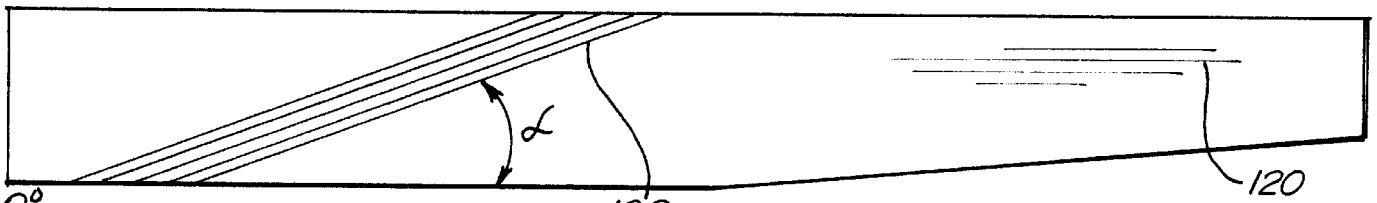
Figure 10C:
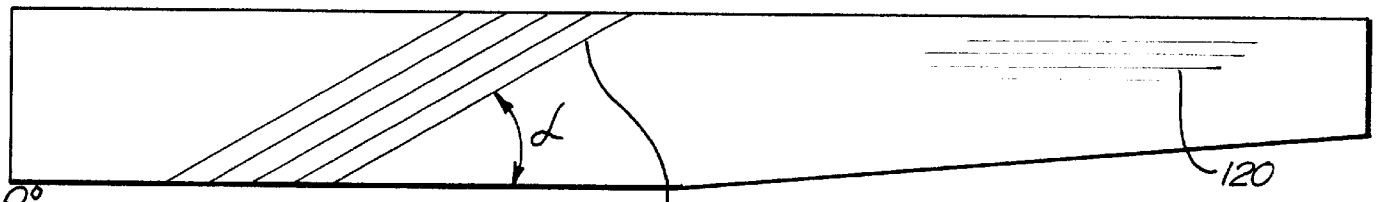
Figure 10D:
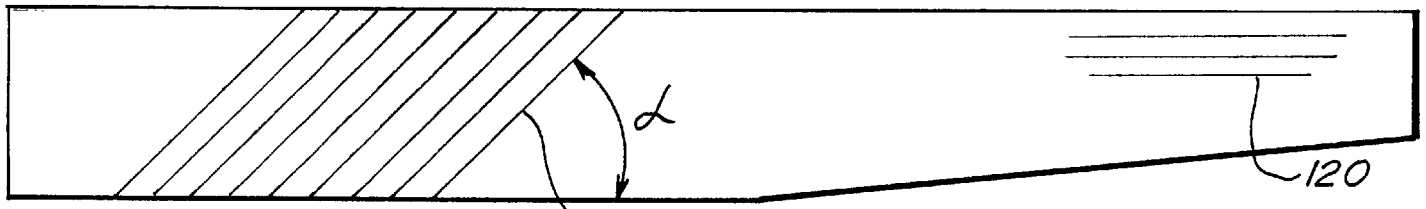
Figure 10E:
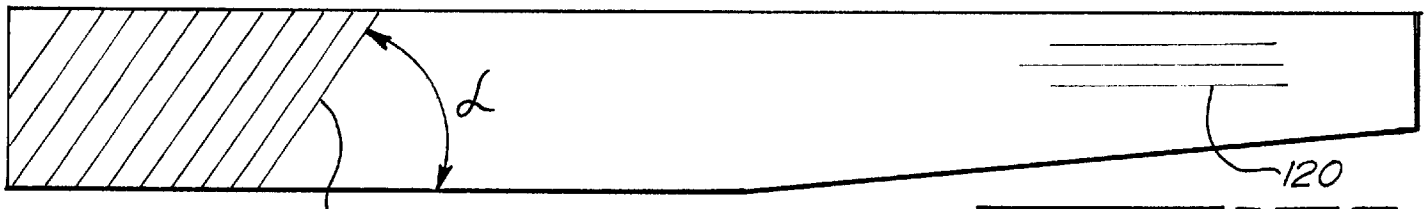
Figure 10F:
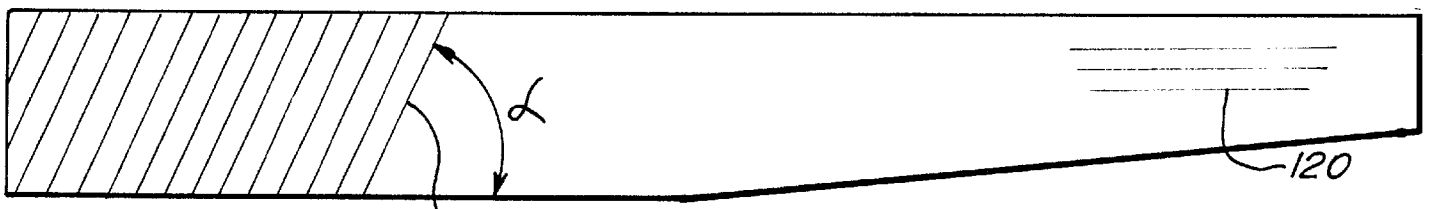
Figure 10G:
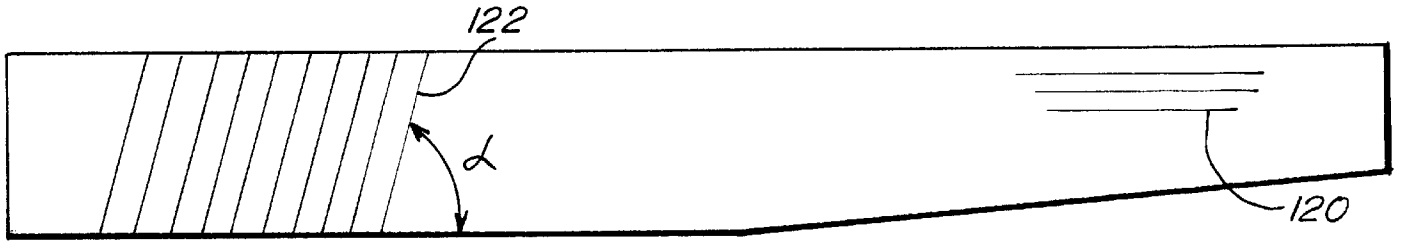
Figure 10H:
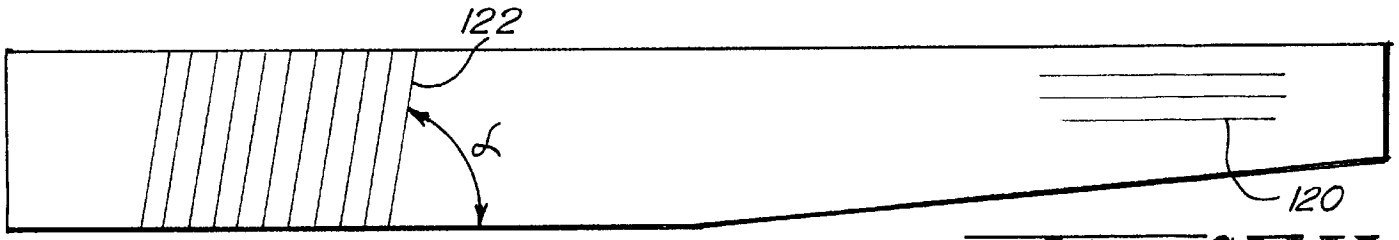
Figure 10I:
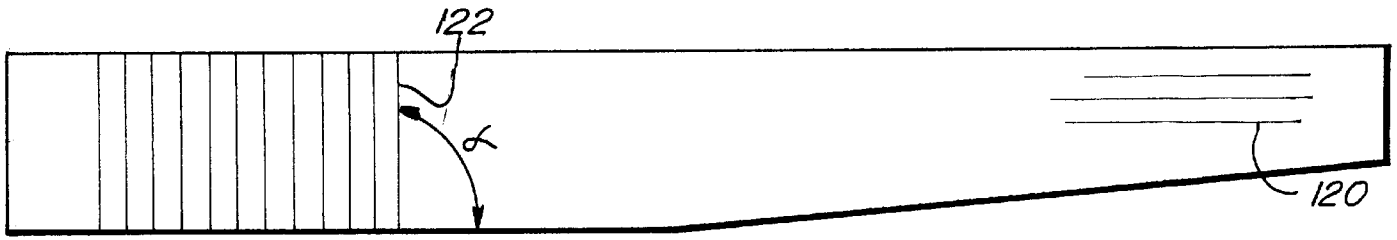

A novel method of manufacture of the graphite arrow 10 is disclosed as follows. See FIGS. 3 and 4.

In the first step, a sheet 50 of graphite fibers embedded in a resin 24 is trimmed to produce an elongate longitudinal pattern 52 having a parallel portion 54 with parallel sides 56 and a tapered portion 58 with tapered side 59. The pattern 52 may have an adhesive 60 on its backside. Preferably, the adhesive is present on the backside of the sheet 50 and is covered by a removable backing paper 62. This longitudinal pattern 52 produces the longitudinally oriented graphite fibers 20 of the finished arrow.

Next, the sheet 50 is trimmed to produce a bias pattern 70 of about the length of the longitudinal pattern 52 and with the graphite fibers biased to the direction of the longitudinal pattern. Because the fibers only run in one direction in the sheet 50, the bias pattern 70 can be produced by trimming the sheet 50 across the grain. The bias pattern 70 is also trimmed to have a width less than the width of the longitudinal pattern 52. A sheet 50 of material with a different fiber weight is used than was used to produce the longitudinal pattern 52.

Next, the bias pattern 70 is attached to the longitudinal pattern 52 with the bias pattern offset from the edges 56, 59 of the longitudinal pattern 52. This can conveniently be done by removing the backing paper 62 from the bias pattern 70 and pressing the adhesive 60 against the longitudinal pattern 52.

The longitudinal pattern 52 with attached bias pattern 70 is then attached to an elongate, tapered mandrel 80 along one edge 56 by the adhesive 60. See FIG. 5. Optionally, a release agent (not shown) may be applied to the mandrel 80 before attaching the patterns to promote release of the finished arrow from the mandrel 80. The release agent is generally a carnuba-based wax. In this case, a tacking agent is applied over the release agent to allow the adhesive 60 to stick to the mandrel 80. The tacking agent is preferably an epoxy resin.

Figure 5:
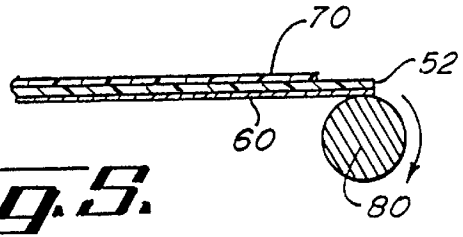
FIG. 5 is a schematic showing a method of rolling a sheet of graphite fibers onto a mandrel, to manufacture the graphite arrow of the present invention.

The longitudinal pattern 52 and bias pattern 70 are then rolled onto the mandrel 80 as shown by the arrow in FIG. 5. Preferably, the bias pattern 70 is oriented off□center of the longitudinal pattern 52 so that the bias pattern 70 does not wrap around the mandrel 80 until one fall wrap of the longitudinal pattern 52 has been applied to the mandrel 80.

To strengthen the arrow 10, multiple layers of longitudinal pattern 52 and bias pattern 70 may be wrapped around the mandrel 80. Preferably, four layers of longitudinal pattern 52 and two layers of bias pattern 70 are wrapped around the mandrel 80.

Applicant has found that the patterns may be best rolled onto the mandrel 80 by using a rolling table from Century Design of San Diego, Calif. The rolling table (not shown) has a top portion which slidingly engages a bottom portion. The patterns and mandrel are placed on the bottom portion and the top portion rolls over the bottom portion, causing the patterns to roll onto the mandrel. The rolling machine has heated platens that warm the patterns as they are rolled onto the mandrel. The platens may be heated as high as 200 degrees Fahrenheit.

In the next step, the patterns rolled onto the mandrel 80 are covered with a polypropylene tape 82. Applicant has found that a cello wrapping machine from Century Design, San Diego, Calif. may efficiently be used to apply the tape to the patterns. FIG. 6 shows the resulting layers.

Next, the mandrels are heated to about 250 to 300 degrees Fahrenheit for about 1 hour. The heating step causes the resin 24 to cure, producing a cured product 90. The polypropylene tape 82 prevents the resin 24 from melting and falling off the mandrel 80. Also, the tape 82 shrinks when heated and creates better laminations of fibers. Heating may be efficiently performed in an oven from Steelman of Fort Worth, Tex. or Dispatch from Milwaukee, Wis.

Next the cured product 90 is removed from the mandrel 80. FIG. 7 shows the mandrel 80 being pulled out of the cured product 90. The optional release agent may aid this process. Applicant has built a "pulling" machine (not shown) which grabs the mandrel by a notch at one end and pulls the mandrel through a hole smaller than the diameter of the cured product 90, stripping the cured product 90 off the mandrel 80.

Next, the tape 82 is removed from the cured product. Preferably, the cello wrapping machine will have wrapped the tape 82 spirally around the patterns so that the tape can be easily unwound as shown in FIG. 8.

The cured product is then sanded to remove edges of the hardened resin left on the cured product 90 by the tape 82. A centerless sander (not shown) from Century Design of San Diego, Calif. may be used to spin the cured product 90 while it is being sanded.

The cured product is then cut to appropriate lengths to make finished arrows 10. The parallel portion 30 is cut, so that the spine (stiffness) of the arrow remains the same regardless of the finished length.

The finished arrows at their tip may preferably have an outside diameter of about 0.338 inches and a hollow interior 14 with a diameter of about 0.287 inches. The finished arrows taper about 0.004 inch per inch of tapered portion.32. At the knock end, the finished arrows preferably have an outside diameter of about 0.271 inches and a hollow interior with a diameter of about 0.212 inches.

The finished graphite arrows 10 have great strength due to the combination of the longitudinally oriented fibers 20 and biased fibers 22. Applicant has found that the arrows 10 have a crush strength of about 50% greater than that of earlier graphite arrows such as those from Taylor Falcon of Jonesborough, Ark. The arrow 10 will not bend when it hits a hard object. The arrow will not splinter when it hits a hard object, so that the tip does not get pushed inside the shaft 12.

The arrow 10 is lighter in weight and flies faster than aluminum arrows, developing more kinetic energy.

Because the optional mold release is on the inside of the shaft, not the outside, less extensive sanding is needed than with earlier pultruded graphite arrows.

The characteristics of the arrow 10 allow it to be easily tuned with a fixed blade broadhead tip.

The tapered portion 32 allows easier penetration of a game animal than earlier arrows that were non-tapered.

The arrow 10 has a shorter paradox than earlier arrows and thus has less oscillation along the shaft 12 resulting in higher accuracy in flight, so that it shoots farther with the same accuracy. The shorter paradox also allows greater penetration into a game animal. Paradox is the amount of bowing produced in the shaft when a force is placed against one end of the shaft, such as caused by a bowstring. Parallel shafts have greater paradox than tapered shafts.

The arrow 10 also has a greater spine weight range (up to 100 pounds) than earlier arrows. This is advantageous for heavier bow weights (60 pounds and greater) and for finger shooters that don't use a release. The greater spine or stiffer shaft prevents the shaft from wiggling around as the shooter pulls the arrow back.

The arrow 10 also has a front of center (balance point) about 10 to 15% closer towards the tip portion 18 than previous arrows. This enables the arrow 10 to be tuned and fly better with a broad head tip.

Figure 11:
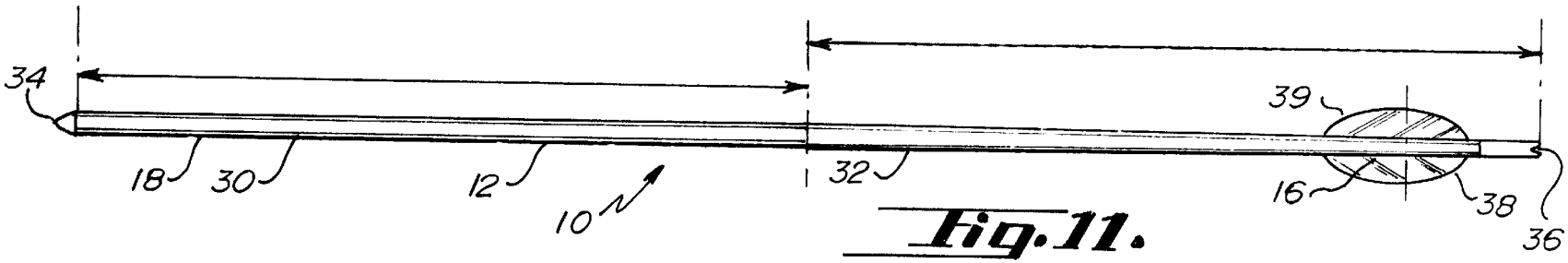
FIG. 11 is an elevational view of an embodiment of the arrow of the present invention, having a parallel portion of 50% of the shaft length and a tapered portion of 50% of the shaft length.
Figure 12:
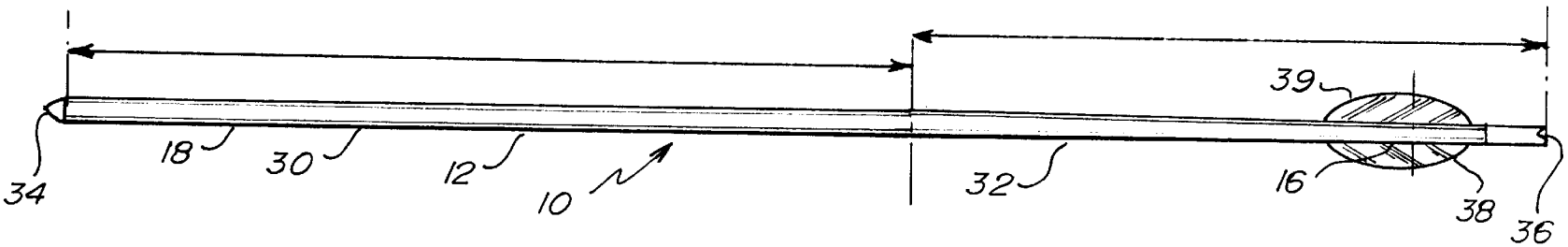
FIG. 12 is an elevational view of an embodiment of the arrow of the present invention having a parallel portion of 60% of the shaft length and a tapered portion of 40% of the shaft length.

Additional embodiments of the arrow of the present invention are shown in FIGS. 10, 11, and 12.

In these additional embodiments, the arrow 10 is constructed of a fiber-reinforced material. Materials that can be used for the fibers include graphite, organic fiberglass, and inorganic fiberglass.

As in the earlier embodiments, the fibers are embedded in a binder 24 such as a thermoplastic epoxy resin.

In these new embodiments, the arrow is constructed of a plurality of first fibers 120 longitudinally oriented along the shaft 12 and a plurality of second fibers 122 biased to the longitudinally oriented fibers.

The second fibers may be biased to the first fibers at an angle $\alpha$ between about 10 degrees and about 90 degrees. The Figures illustrate angles of 10, 20, 30, 45, 55, 65, 75, 80, and 90 degrees. However, this list is not intended to be restrictive and other angles could be used. These various bias angles have been found to improve the hoop or crush strength of the arrow 10.

As in earlier embodiments, there may be multiple layers of the first fibers and multiple layers of the second fibers.

Preferably, the second fibers lie inside the first fibers along the length of the shaft, but the second fibers could alternatively lie outside the first fibers.

Earlier embodiments showed that the arrow 10 had a parallel portion of about 40% of the shaft 12 length and a tapered portion of about 60% of the shaft 12 length. New embodiments shown in FIGS. 11 and 12 show parallel 30 and tapered 32 portions of 50% and 50% (FIG. 11) and 60% and 40% (FIG. 12), respectively. As in the earlier embodiments, the parallel portion 30 is preferably adjacent the tip portion 18 and the tapered portion 32 is adjacent the fletching portion 16. Preferably, the diameter of the tapered portion 32 gradually and continuously decreases from the parallel portion 30 toward the fletching portion 16. A second parallel portion 39 may be adjacent the tapered portion 32, with the second parallel portion 39 forming the fletching portion 16.

The method of manufacture of the new embodiments is not limited to pre-impregnation of fibers in the binder 24. The fibers may be filament wound and then impregnated with the resin.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A fiber-reinforced archery arrow having an elongate shaft, a fletching portion at a first end of the shaft, and a tip portion at a second end of the shaft, the shaft comprising:

(a) a plurality of first fibers longitudinally oriented along the shaft;

(b) a plurality of second fibers biased to the longitudinally oriented fibers;

(c) a binder holding together the first fibers and the second fibers;

(d) the shaft further comprising a parallel portion and a tapered portion; and (e) wherein the parallel portion is adjacent the tip portion and the tapered portion is between the parallel portion and the fletching portion, wherein the diameter of the tapered portion gradually and continuously decreases from the parallel portion.

2. The arrow of claim 1, wherein the first fibers and the second fibers are selected from the group consisting of graphite, organic fiberglass, and inorganic fiberglass.

3. The arrow of claim 1, wherein the binder is a thermoplastic epoxy resin.

4. The arrow of claim 1, wherein the second fibers are biased to the first fibers at an angle between about 10 degrees and about 90 degrees.

5. The arrow of claim 1, wherein the second fibers are inside the first fibers along the shaft.

6. The arrow of claim 1, wherein the parallel portion and the tapered portion each comprise about 50% of the shaft length.

7. The arrow of claim 1, wherein the parallel portion comprises about 60% of the shaft length and the tapered portion comprises about 40% of the shaft length.

8. The arrow of claim 1, wherein the parallel portion comprises about 40% of the shaft length and the tapered portion comprises about 60% of the shaft length.

9. The arrow of claim 1, further comprising a second parallel portion at the first end forming the fletching portion.

10. A fiber-reinforced archery arrow having an elongate shaft, a fletching portion at a first end of the shaft, and a tip portion at a second end of the shaft, the shaft comprising:

(a) a plurality of first fibers longitudinally oriented along the shaft;

(b) a plurality of second fibers biased to the longitudinally oriented fibers at an angle from about 10 degrees to about 90 degrees;

(c) a binder holding together the first fibers and the second fibers; and (d) the shaft further comprising a parallel portion and a tapered portion, wherein the parallel portion is adjacent the tip portion and the tapered portion is between the parallel portion and the fletching portion, and wherein the diameter of the tapered portion gradually and continuously decreases from the parallel portion.

11. The arrow of claim 10, further comprising a second parallel portion at the first end forming the fletching portion.

* * * * *